US012227917B2

(12) United States Patent
Kovar et al.

(10) Patent No.: US 12,227,917 B2
(45) Date of Patent: Feb. 18, 2025

(54) YOKE ASSEMBLY FOR EXCAVATOR THUMB

(71) Applicant: Caterpillar Inc., Peoria, IL (US)

(72) Inventors: Aaron D Kovar, Topeka, KS (US); Ryan P Shea, Wamego, KS (US)

(73) Assignee: Caterpillar Inc., Peoria, IL (US)

( * ) Notice: Subject to any disclaimer, the term of this patent is extended or adjusted under 35 U.S.C. 154(b) by 785 days.

(21) Appl. No.: 17/412,843

(22) Filed: Aug. 26, 2021

(65) Prior Publication Data

US 2023/0064244 A1 Mar. 2, 2023

(51) Int. Cl.
*E02F 3/40* (2006.01)

(52) U.S. Cl.
CPC ..... *E02F 3/404* (2013.01)

(58) Field of Classification Search
CPC . E02F 3/404; E02F 3/3604; E02F 3/96; E02F 3/413; E02F 3/962; E02F 3/963; E02F 3/965; E02F 3/4135; E02F 9/006
See application file for complete search history.

(56) References Cited

U.S. PATENT DOCUMENTS

| | | | | |
|---|---|---|---|---|
| 8,920,106 | B2 | 12/2014 | Seljestad | |
| 9,151,012 | B2 | 10/2015 | Seda et al. | |
| 9,376,783 | B2 | 6/2016 | Ulrich et al. | |
| 9,476,179 | B2 * | 10/2016 | Seljestad | E02F 3/413 |
| 9,481,978 | B2 | 11/2016 | Seda et al. | |
| 2010/0058622 | A1 | 3/2010 | Calvert et al. | |
| 2014/0007467 | A1 | 1/2014 | Kovar et al. | |
| 2014/0101976 | A1 * | 4/2014 | Shea | E02F 3/404 37/406 |
| 2014/0102243 | A1 | 4/2014 | Shea et al. | |
| 2018/0135271 | A1 * | 5/2018 | Gonzalez | E02F 3/3613 |

FOREIGN PATENT DOCUMENTS

| | | | |
|---|---|---|---|
| CN | 204703221 | U | 10/2015 |
| CN | 105256851 | A | 1/2016 |
| JP | 2013221284 | A | 10/2013 |
| JP | 5709791 | B2 | 4/2015 |
| JP | 6360945 | B2 | 8/2017 |

OTHER PUBLICATIONS

Written Opinion and International Search Report for Int'l. Patent Appln. No. PCT/US2022/038289, mailed Nov. 30, 2022 (17 pgs).

* cited by examiner

*Primary Examiner* — Thomas B Will
*Assistant Examiner* — Robert E Pezzuto

(57) ABSTRACT

A thumb for a machine implement has first and second side plates having a pivot end for pivotally connecting to a linkage of the machine and an engagement end for engaging with a load. A belly plate extends across a width of the thumb between the first and second side plates and along a length of the thumb from the pivot end toward the engagement end. A yoke assembly mounted to a surface of the belly plate is configured to connect the thumb to a thumb actuator that pivots the thumb about the pivot end. A first yoke plate has a first opening and a second yoke plate opposing the first yoke plate has a second opening aligned with the first opening. First and second inner collar spacers are respectively mounted to inner surfaces of the first and second yoke plates aligned with the first and second openings.

22 Claims, 7 Drawing Sheets

YOKE ASSEMBLY FOR EXCAVATOR THUMB

TECHNICAL FIELD

This disclosure relates generally to excavator machines having articulating ground-engaging implements with counteracting thumbs. In particular, this disclosure relates to a yoke assembly for the thumb.

BACKGROUND

Mining and construction machines such as backhoe loaders and excavators employ various implements—such as buckets, rams, forks, grapples, thumbs, and the like, to perform different operations. For example, a machine may use a bucket and counteracting thumb to grasp, hold, and lift work material such as boulders, pipes, trees, structural components, and the like.

The thumb typically connects to the machine's linkage at two points: a first set of openings at one end for connecting the thumb to the stick of the linkage and about which the thumb pivots during operation; and a second set of openings, spaced away from the first set of opening in the body of the thumb, for connecting to the actuator (e.g., a hydraulic actuator). The distance between the two sets of openings creates a lever for the hydraulic actuator to open and close the thumb, pivoting the thumb with respect to an axis defined by the first set of openings.

Various techniques may be used to fasten the thumb to the two connection points. For example, U.S. Patent Application Publication No. 2010/0058622 to Calvert et al. ("the '622 publication") describes a thumb that attaches to an excavator arm at the pivot end by inserting a pin through a set of aligned openings. The pin has a plurality of spacers on it, but the '622 patent does not describe how the spacers are used, if at all, in securing the thumb to the excavator arm. The thumb also includes flanges with another set of openings for engaging a thumb pin to secure the bush of a hydraulic ram to the thumb. But only a bush of a certain size may properly fit between the flanges. Additionally, the '622 patent does not disclose any structure(s) to support the flanges during operation of the excavator.

This disclosure is directed to one or more improvements in the existing excavator thumb technology.

SUMMARY

One aspect of the disclosure is directed to a thumb for an implement of a machine. The thumb may include first and second side plates each having a pivot end for pivotally connecting to a linkage of the machine and an engagement end for engaging with a load. The thumb may further include a belly plate extending across a width of the thumb between the first and second side plates and extending along a length of the thumb from the pivot end toward the engagement end. The thumb may include a yoke assembly mounted to a surface of the belly plate and configured to connect the thumb to a thumb actuator that pivots the thumb about the pivot end. The yoke assembly may include a first yoke plate having a first yoke plate opening, a second yoke plate opposing the first yoke plate and having a second yoke plate opening aligned with the first yoke plate opening. The yoke assembly may further include a first inner collar spacer mounted to an inner surface of the first yoke plate aligned with the first yoke plate opening and a second inner collar spacer mounted to an inner surface of the second yoke plate aligned with the second yoke plate opening.

Another aspect of the disclosure relates to a method of providing a thumb for an implement of a machine. The method may include providing first and second side plates each having a pivot end for pivotally connecting to a linkage of the machine and an engagement end for engaging with a load. The method may further include providing a belly plate extending across a width of the thumb between the first and second side plates and extending along a length of the thumb from the pivot end toward the engagement end. The method may further include mounting a yoke assembly to a surface of the belly plate, the yoke assembly configured to connect the thumb to a thumb actuator that pivots the thumb about the pivot end. The mounting of the yoke assembly may include mounting, to the surface of the belly plate, a first yoke plate having a first yoke plate opening and mounting, to the surface of the belly plate, a second yoke plate opposing the first yoke plate and having a second yoke plate opening aligned with the first yoke plate opening. The method may further include mounting, to an inner surface of the first yoke plate aligned with the first yoke plate opening, a first inner collar spacer and mounting, to an inner surface of the second yoke plate aligned with the second yoke plate opening, a second inner collar spacer.

Yet another aspect of the disclosure relates to a machine including a linkage and an implement pivotally connected to the linkage, the implement having a thumb. The thumb may include first and second side plates each having a pivot end for pivotally connecting to the linkage and an engagement end for engaging with a load. The thumb may include a belly plate extending across a width of the thumb between the first and second side plates and extending along a length of the thumb from the pivot end toward the engagement end. The thumb may include a yoke assembly mounted to a surface of the belly plate and configured to connect the thumb to a thumb actuator that pivots the thumb about the pivot end. The yoke assembly may include a first yoke plate having a first yoke plate opening and a second yoke plate opposing the first yoke plate and having a second yoke plate opening aligned with the first yoke plate opening. Additionally, the yoke assembly may include a first inner collar spacer mounted to an inner surface of the first yoke plate aligned with the first yoke plate opening and a second inner collar spacer mounted to an inner surface of the second yok plate aligned with the second yoke plate opening.

Another aspect relates to a side plate for a thumb of an implement of a machine. The side plate may have a pivot end for pivotally connecting to a linkage of the machine and an engagement end for engaging with a load. The side plate may have an opening for receiving a thumb actuator pivot pin to connect a thumb actuator of the machine to the thumb. The opening may have a hexagonal shape.

Still another aspect relates to a thumb for an implement of a machine. The thumb may include first and second side plates having a pivot end for pivotally connecting to a linkage of the machine and an engagement end for engaging with a load. The thumb may include a belly plate extending across a width of the thumb between the first and second side plates and extending along a length of the thumb from the pivot end toward the engagement end. The thumb may include first and second yoke plates mounted to a surface of the belly plate, the first and second side plates having respective first and second yoke plate openings for retaining a thumb actuator pivot pin that pivotally connects the thumb to a thumb actuator. Additionally, the thumb may include first and second side plate openings respectively in the first and second side plates, the first and second side plate openings for receiving the thumb actuator pivot pin for insertion through the first and second yoke plate openings. At least one of the first and second side plate openings may have a hexagonal shape.

DETAILED DESCRIPTION

Reference will now be made in detail to specific embodiments or features, examples of which are illustrated in the accompanying drawings. Wherever possible, corresponding or similar reference numbers will be used throughout the drawings to refer to the same or corresponding parts.

Figure 1:
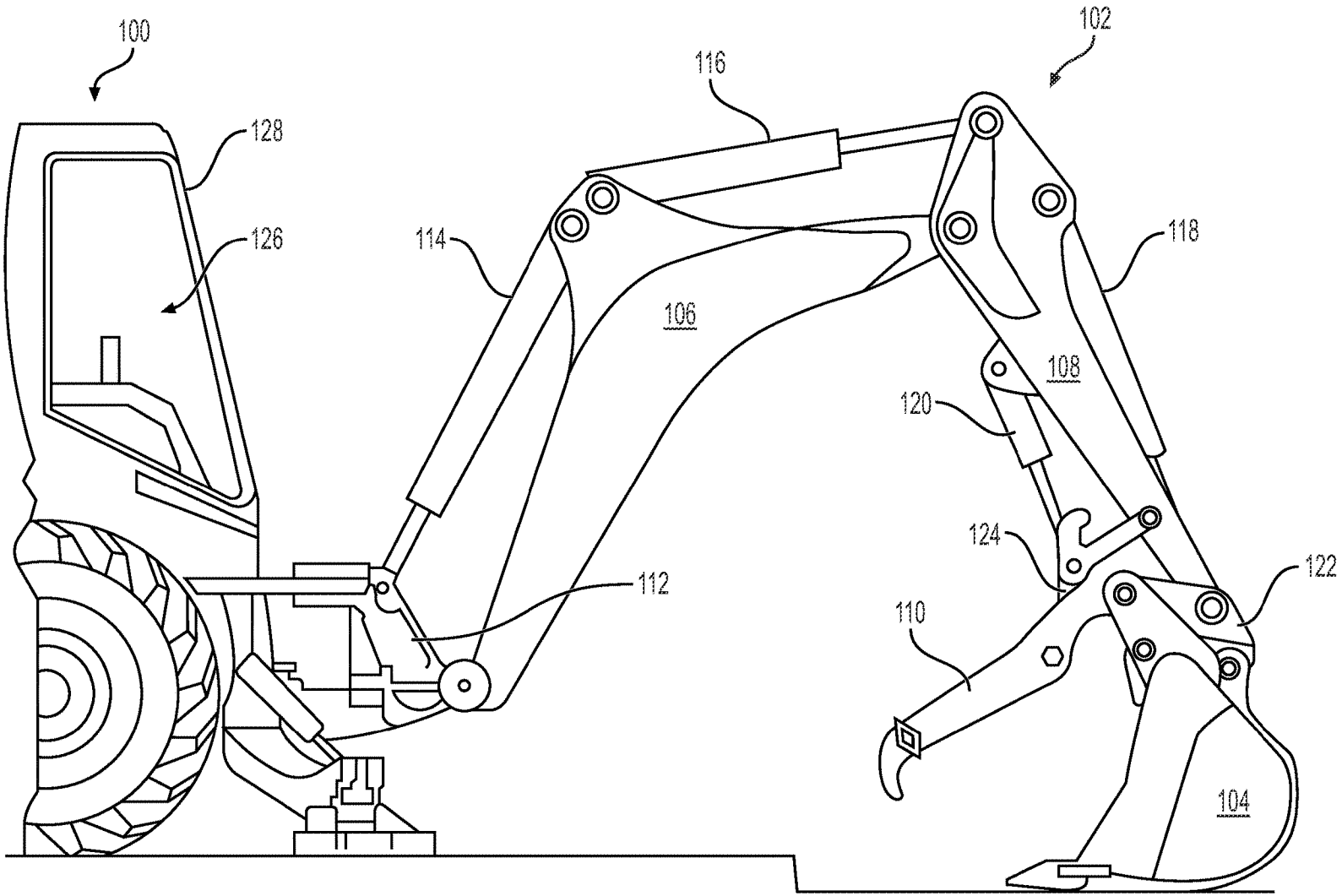
FIG. 1 is a side elevation view of a machine having an articulating ground-engaging implement with a counteracting thumb in accordance with the present disclosure.

FIG. 1 depicts a machine 100 to perform different operations on work material at a work site. Machine 100 may include a linkage assembly 102 for manipulating an implement, such as bucket 104, to perform the operations on the work material. While machine 100 is depicted as a backhoe loader, machine 100 may alternatively be an excavator or any other type of machine having a linkage for performing operations with an implement on work material.

As shown, linkage assembly 102 includes a boom 106, a stick 108 pivotally coupled to boom 106, bucket 104 pivotally coupled to stick 108, and a counteracting thumb 110 also pivotally coupled to stick 108. Linkage assembly 102 may pivotally connect to a boom support bracket 112 of machine 100. Additionally, a boom lift actuator 114 is operably coupled between boom 106 and machine 100 to rotate boom 106 with respect to machine 100, raising and lowering linkage assembly 102.

Similarly, a stick extension actuator 116 is operably coupled between boom 106 and stick 108 to rotate stick 108 with respect to boom 106. A bucket articulation actuator 118 and a thumb actuator 120 are operably coupled between stick 108 and bucket 104 and between stick 108 and thumb 110, respectively, by respective linkages 122, 124, and rotate bucket 104 and thumb 110, respectively, with respect to stick 108. Actuators 114, 116, 118, 120 may be hydraulic cylinders each having a head end and a rod end. Hydraulic fluid directed to the head ends may extend actuators 114, 116, 118, 120, while hydraulic fluid directed to the rod ends may retract actuators 114, 116, 118, 120. An operator may use a plurality of levers 126, or other operator interface devices, within an operator cab 128 of machine 100 to command actuators 114, 116, 118, 120 through a control device (not shown).

During operation of machine 100, bucket 104 and thumb 110 in combination may be used to pick up loads of work material, including odd- or irregular-sized loads. For example, the operator of machine 100 may pick up a boulder by scooping the boulder into bucket 104 and manipulating levers 126 to actuate thumb actuator 120 to close thumb 110 over bucket 104 and engage and hold the boulder until the boulder is dumped. As another example, elongated work material, such as tree trunks and piping may be picked up by enclosing the material with bucket 104 and thumb 110, closing bucket 104 and thumb 110 around the work material, and lifting the material off the ground. Manipulating these types of materials can impose unbalanced loads on bucket 104 and thumb 110 such that more force is exerted on some areas of bucket 104 and thumb 110 than others, creating concentrated stresses that, over time, may damage bucket 104 and/or thumb 110.

Figure 2:
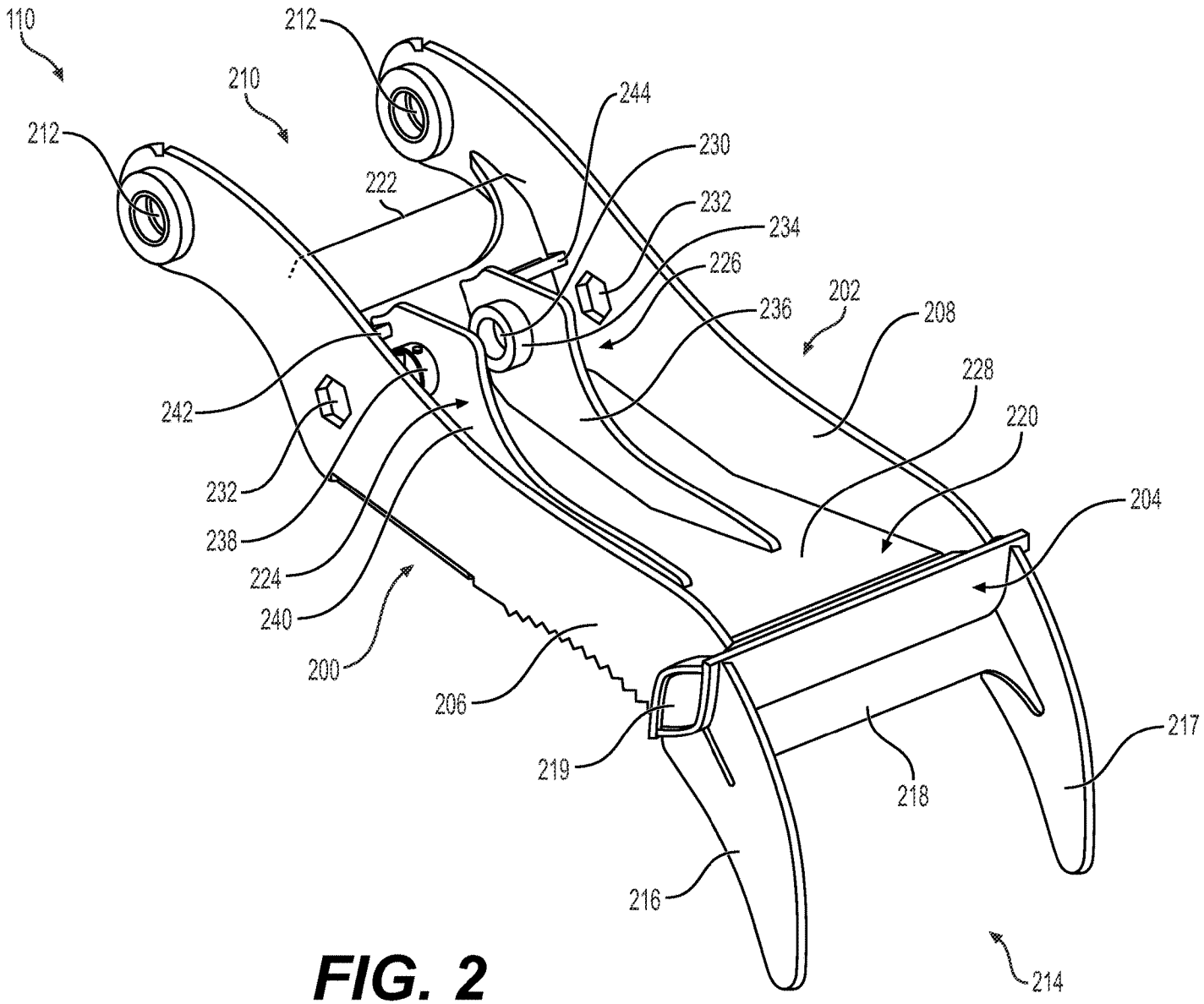
FIG. 2 is a front right perspective view of the counteracting thumb of the machine of FIG. 1.
Figure 3:
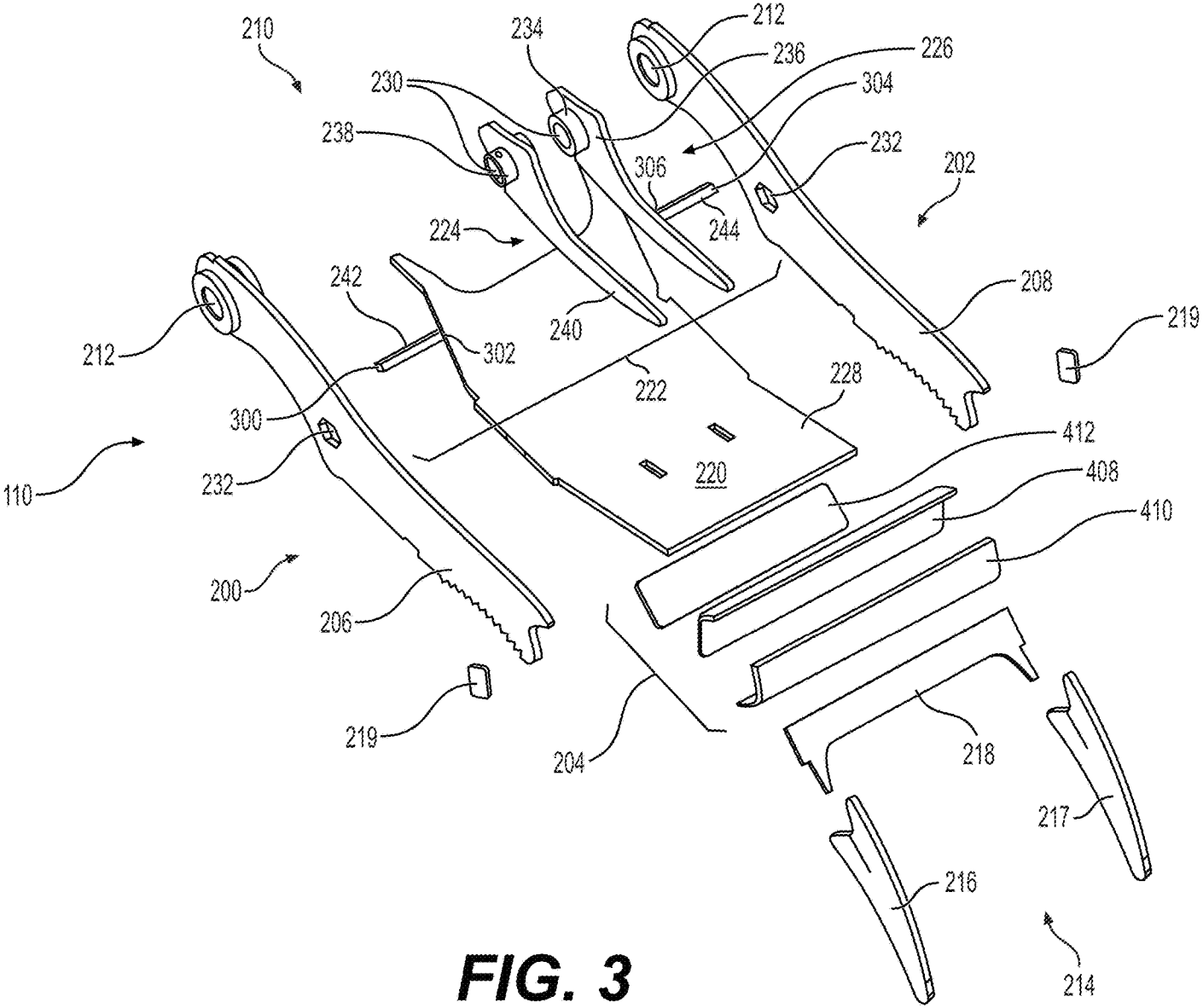
FIG. 3 is an exploded view of the counteracting thumb of the machine of FIG. 1.

FIG. 2 illustrates thumb 110, in accordance with the present disclosure, with a yoke assembly configured to accommodate a thumb actuator 120 with a narrow cylinder head. FIG. 3 provides an exploded view of the components of thumb 110. As shown in FIGS. 2 and 3, thumb 110 may include a first side plate 200 and a second side plate 202. An attachment having a plurality of teeth (not shown) may be connected to thumb 110 by mounting it to a thumb support structure 204 configured to support tines and/or teeth attached to thumb 110.

Each of first and second side plates 200, 202 may include an outer surface 206 and an inner surface 208 facing inner surface 208 of the opposite side plate 200, 202. At a pivot end 210 of thumb 110, first and second side plates 200, 202 may have reinforced openings 212 for pivotally connecting first and second side plates 200, 202 to stick 108 via a stick pivot pin (not shown). The stick pivot pin may be shared with bucket 104 or with a coupler (not shown) connecting bucket 104 to stick 108. At a material engagement end 214 of thumb 110, first and second side plates 200, 202 may transition into respective tines 216, 217 for engaging the work material alongside the teeth, if attached to thumb 110. The transition may be integral or tines 216, 217 may be separate structures attached, directly or indirectly, to the respective first and second side plates 200, 202.

At material engagement end 214, thumb 110 may include a gusset plate 218 extending between first and second side plates 200, 202 and configured to support and unitize tines 216, 217 and the thumb teeth (if attached), providing additional strength to withstand lateral forces acting on tines 216 and/or the teeth in a direction generally parallel to an axis defined by openings 212. As shown in FIG. 2, gusset plate 218 may be located at material engagement end 214 of thumb support structure 204 and extend between tines 216, 217—across the width of thumb support structure 204 from inner surface 208 of one side plate 200 to inner surface 208 of the other side plate 202. Additionally, thumb support structure 204 may have end caps 219 covering openings in first and second side plates 200, 202 defined by thumb support structure 204.

Thumb 110 may include a belly plate 220 in the interior of thumb 110. Belly plate 220 may extend across the width of thumb 110 between first and second side plates 200, 202 and may further extend along a length of thumb 110 from at or proximate to pivot end 210, in the direction of material engagement end 214, to thumb support structure 204.

Belly plate 220 may provide an attachment surface for components of thumb 110 to which linkage 124 connects. For example, as shown in FIGS. 2 and 3, belly plate 220 may serve as an attachment surface for a yoke assembly 222 configured to pivotally attach thumb 110 to thumb actuator 120. Yoke assembly 222 may include a first yoke plate 224 aligned with and spaced widthwise apart from a second yoke plate 226 and mounted by welding to an exterior surface 228 of belly plate 220. First and second yoke plates 224, 226 may be planar and lie in planes substantially perpendicular to all or part of exterior surface 228 of belly plate 220 and substantially parallel to first and second side plates 200, 202. Additionally, first and second yoke plates 224, 226 may extend from at or proximate to pivot end 210 toward material engagement end 214 and, in some embodiments, may have a height, as measured from exterior surface 228 of belly plate 220, tapering in the direction from pivot end 210 to material engagement end 214. That is, first and second yoke plates 224, 226 may have a first height measured from exterior surface 228 of belly plate 220 on the side of pivot end 210 and may gradually taper to a second height, less than the first height, toward material engagement end 214.

First and second yoke plates 224, 226 may have respective yoke plate openings 230 through which a thumb actuator pivot pin (not shown) may extend between and through first and second yoke plates 224, 226 to pivotally connect thumb 110 to thumb actuator 120. Yoke plate openings 230 may align with corresponding side plate openings 232 for installing the thumb actuator pivot pin on thumb 110. Specifically, the thumb actuator pivot pin may be inserted through one of side plate openings 232 and then through yoke plate openings 230 to connect first and second yoke plates 224, 226 with thumb actuator 120.

As shown in FIGS. 2 and 3, first and second yoke plates 224, 226 may have respective inner collar spacers 234 mounted on respective inner surfaces 236 of first and second yoke plates 224, 226 over and in coaxial alignment with yoke plate openings 230. For example, inner collar spacers 234 may be welded to inner surfaces 236 of first and second yoke plates 224, 226. Additionally, an outer collar 238 may be mounted by welding to an outer surface 240 of at least one of first and second yoke plates 224, 226 over and in coaxial alignment with its respective yoke plate opening 230 for securing the thumb actuator pivot pin. In the embodiment shown, outer collar 238 is mounted to first yoke plate 224. In other embodiments, however, outer collar 238 may be mounted to second yoke plate 226, or outer collars 238 may be mounted to both first and second yoke plates 224, 226.

As explained in more detail below, the thumb actuator pivot pin may be inserted through side plate opening 232 on, for example, second side plate 202 and further inserted through yoke plate opening 230 on second yoke plate 226, through its respective inner collar spacer 234, through the inner collar spacer 234 on first yoke plate 224, through yoke plate opening 230 on first yoke plate 224, and finally through outer collar 238 on outer surface 240 of first yoke plate 224. The actuator pivot pin may then be secured to outer collar 238 using a fastener such as a bolt or a cotter pin to prevent movement.

With further reference to FIGS. 2 and 3, yoke assembly 222 may further include first and second reinforcement ribs 242, 244 respectively reinforcing first and second yoke plates 224, 226. First reinforcement rib 242 may lie on exterior surface 228 of belly plate 220 and extend from inner surface 208 of first side plate 200 to outer surface 240 of first yoke plate 224. That is, a first end 300 of first reinforcement rib 242 may abut inner surface 208 of first side plate 200 and a second end 302 of first reinforcement rib 242 may abut outer surface 240 of first yoke plate 224. Similarly, second reinforcement rib 244 may lie on exterior surface 228 of belly plate 220 and extend from inner surface 208 of second side plate 202 to outer surface 240 of second yoke plate 226. That is, a first end 304 of second reinforcement rib 244 may abut inner surface 208 of second side plate 202 and a second end 306 of second reinforcement rib 244 may abut outer surface 240 of second yoke plate 226.

First and second reinforcement ribs 242, 244 may be welded in place. For example, first and second reinforcement ribs 242, 244 may be welded to exterior surface 228 of belly plate 220 along the respective lengths of first and second reinforcement ribs 242, 244. Additionally, first end 300 of first reinforcement rib 242 may be welded to inner surface 208 of first side plate 200 and second end 302 of first reinforcement rib 242 maybe welded to outer surface 240 of first yoke plate 224. Similarly, first end 304 of second reinforcement rib 244 may be welded to inner surface 208 of second side plate 202 while second end 306 of second reinforcement rib 244 may be welded to outer surface 240 of second yoke plate 226.

First and second reinforcement ribs 242, 244 may at least partially reinforce first and second yoke plates 224, 226 respectively from forces acting in directions generally parallel to the axis defined by yoke plate openings 230—that is, forces in directions generally across the width of thumb 110. For example, first and second reinforcement ribs 242, 244 may at least partially prevent first and second yoke plates 224, 226 respectively from bending due to such forces.

If first and second yoke plates 224, 226 are reinforced too much, however, the joints defined by yoke plate openings 230 and the thumb actuator pivot pin may become too rigid or stiff, highly stressing the joints and potentially damaging first and second yoke plates 224, 226, belly plate 220, weld joints between first and second yoke plates 224, 226 and belly plate 220, thumb actuator 120, or other components of thumb 110 or machine 100. At the same time, with insufficient reinforcement of first and second yoke plates 224, 226, the joints may become too unstable for thumb 110 to properly handle material loads during operation of machine 100. Additionally, first and second yoke plates 224, 226, belly plate 220, weld joints between first and second yoke plates 224, 226 and belly plate 220, thumb actuator 120, or other components of thumb 110 or machine 100 may become overly stressed and/or damaged if first and second yoke plates 224, 226 lack sufficient reinforcement.

Accordingly, first and second reinforcement ribs 242, 244 may be configured to allow some flexing or bending of first and second yoke plates 224, 226 while providing sufficient reinforcement and support for proper operation of thumb 110 when handling material loads. For example, first and second reinforcement ribs 242, 244 may allow some flexing of first and second yoke plates 224, 226 while providing enough support for thumb actuator 120 to properly pivot thumb 110 and for thumb 110 to properly handle material loads engaged by machine 100.

Figure 4:
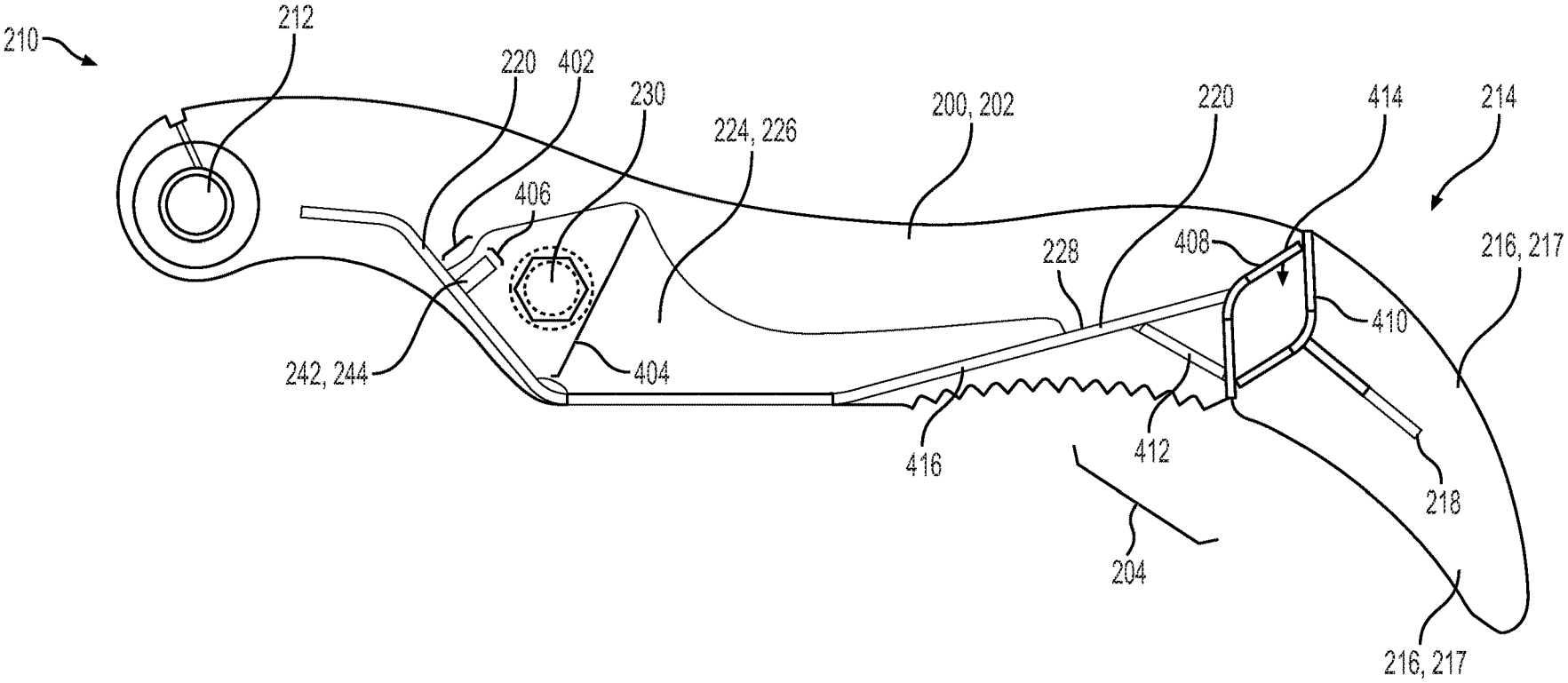
FIG. 4 is a side cross-sectional view of the counteracting thumb of FIG. 2.

Specifically, first and second reinforcement ribs 242, 244 may be located toward a pivot end 210 side of first and second yoke plates 224, 226 and proximate yoke plate openings 230 as show in FIGS. 2-4. In this manner, first and second reinforcement ribs 242, 244 may provide support to first and second yoke plates 224, 226 where the stresses are most concentrated—proximate yoke plate openings 230 where the thumb actuator pivot pin applies forces to first and second yoke plates 224, 226. Although first and second yoke plates 224, 226 are shown as having one reinforcement rib each, it will be appreciated that, in other embodiments, first and second yoke plates 224, 226 may have additional reinforcement ribs (not shown), if desired and/or depending upon the thumb configuration or application. For example, first and second yoke plates 224, 226 may each have one or more additional reinforcement ribs between first and second side plates 200, 202 and first and second yoke plates 224, 226. The additional reinforcement ribs may be spaced apart from first and second reinforcement ribs 242, 244, and from each other, along belly plate 220 in the direction toward material engagement end 214.

FIG. 4 shows a side cross-sectional view of thumb 110. As shown in FIG. 4, first and second reinforcement ribs 242, 244 may be positioned on a pivot end side 210 of yoke plate openings 230—that is, on the side of yoke plate openings 230 closest to pivot end 210 of thumb 110. Additionally, first and second reinforcement ribs 242, 244 may have a height 402, as measured from exterior surface 228 of belly plate 220 in a direction perpendicular to exterior surface 228, that is less than a maximum height 404 of first and second yoke plates 224, 226 as measured from exterior surface 228 in the direction perpendicular to exterior surface 228. For example, height 402 of first and second reinforcement ribs 242, 244 may be in the range of 20-30% of maximum height 404 of first and second yoke plates 224, 226. In one embodiment, height 402 of first and second reinforcement ribs 242, 244 may be about the same as the height of the center of yoke plate openings 230 as measured from exterior surface 228 of belly plate 220.

Additionally, in some embodiments, first and second reinforcement ribs 242, 244 may have a width 406, in the direction parallel to exterior surface 228, that is less than height 402. That is, in the side cross-sectional view taken along the width of thumb 110 shown the length of thumb 110 shown in FIG. 4 (i.e., from pivot end 210 toward material engagement end 214), first and second reinforcement ribs 242, 244 may have a rectangular cross section.

Also as shown in FIG. 4, thumb support structure 204 may be located toward material engagement end 214 of thumb 110 and may comprise a first, second, and third support plates 408-412. First support plate 408 may be convex toward pivot end 210 and connect on its convex side to belly plate 220. Additionally, first support plate 408 may be concave toward, and connect to, second support plate 410. Second support plate 410 may be convex toward material engagement end 214 and concave toward first support plate 408. Additionally, second support plate 410 may connect on its convex side to gusset plate 218 and may connect on its concave side to first support plate 408, forming a cavity 414 between first and second support plates 408, 410. Third support plate 412 may be a flat support plate connecting first support plate 408 to an interior side 416 of belly plate 220—the side of belly plate 220 facing bucket 104.

Figure 5:
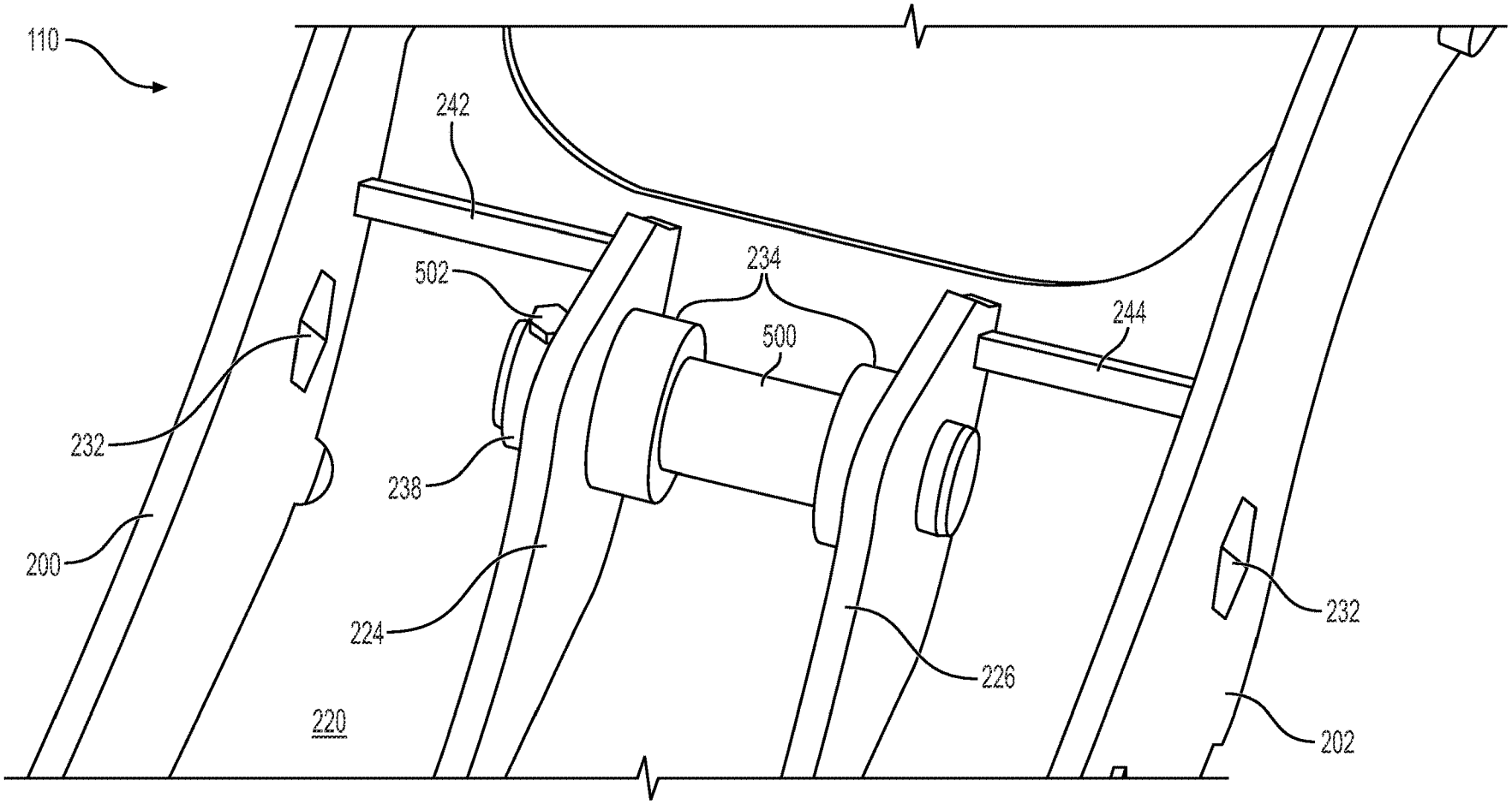
FIG. 5 is a close-up perspective view of the thumb of FIG. 2 with a thumb actuator pivot pin inserted into yoke plates of the thumb.

FIG. 5 shows a view of thumb 110 with thumb actuator pivot pin 500 installed within yoke plate openings 230 of first and second yoke plates 224, 226. As shown, thumb actuator pivot pin 500 may extend through yoke plate openings 230, inner collar spacers 234 and outer collar 238 when installed. In one embodiment, thumb actuator pivot pin 500 may have a length that is less than the inner width of thumb 110 (i.e., the distance between first and second side plates 200, 202). For example, as shown, thumb actuator pivot pin 500 may have a length that is greater than the distance between first and second yoke plates 224, 226 but less than the distance between first and second side plates 200, 202.

Additionally, outer collar 238 may have a fastener 502 that extends through a circumference of outer collar 238 and into an opening (not shown) in the circumference of thumb actuator pivot pin 500, thereby securing thumb actuator pivot pin 500 in place within yoke plate openings 230. For example, fastener 502 may be a cotter pin, a bolt, a ring pin or any other piece of hardware configured to secure thumb actuator pivot pin 500 within outer collar 238.

Figure 6:
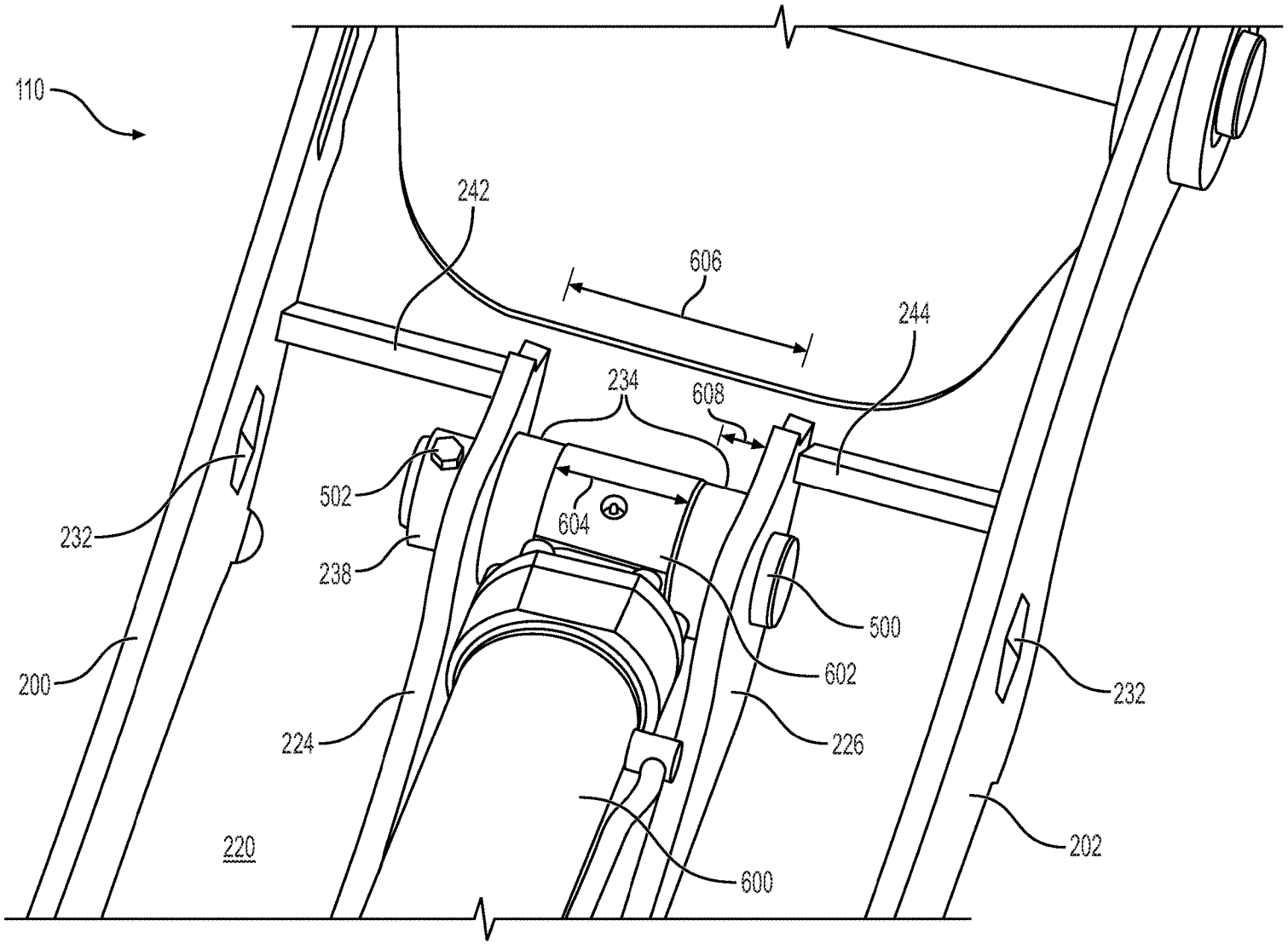
FIG. 6 is a close-up perspective view of the thumb of FIG. 2 with a cylinder head of a thumb actuator 120 installed on the yoke plates of the thumb.

FIG. 6 shows a view of thumb with a cylinder head 600 of thumb actuator 120 installed on first and second yoke plates 224, 226 using thumb actuator pivot pin 500. As shown in FIG. 6, cylinder head 600 may have an attachment end 602 with a width 604 that is less than a distance 606 between first and second yoke plates 224. Inner collar spacers 234, however, may allow attachment end 602 to fit properly between first and second yoke plates 224, 226 so that thumb actuator 120 has proper control over thumb 110. Specifically, inner collar spacers 234 may have a corresponding thickness 608 that effectively reduces distance 606 between first and second yoke plates 224, 226 to substantially equal to width 604 of attachment end 602. In this manner, when cylinder head 600 is installed on first and second yoke plates 224, 226, attachment end 602 may be flush with inner collars spacers 234. That is, outer surfaces of attachment end 602 defining width 604 may be substantially flush with corresponding inner surfaces of inner collars spacers 234.

Figure 7:
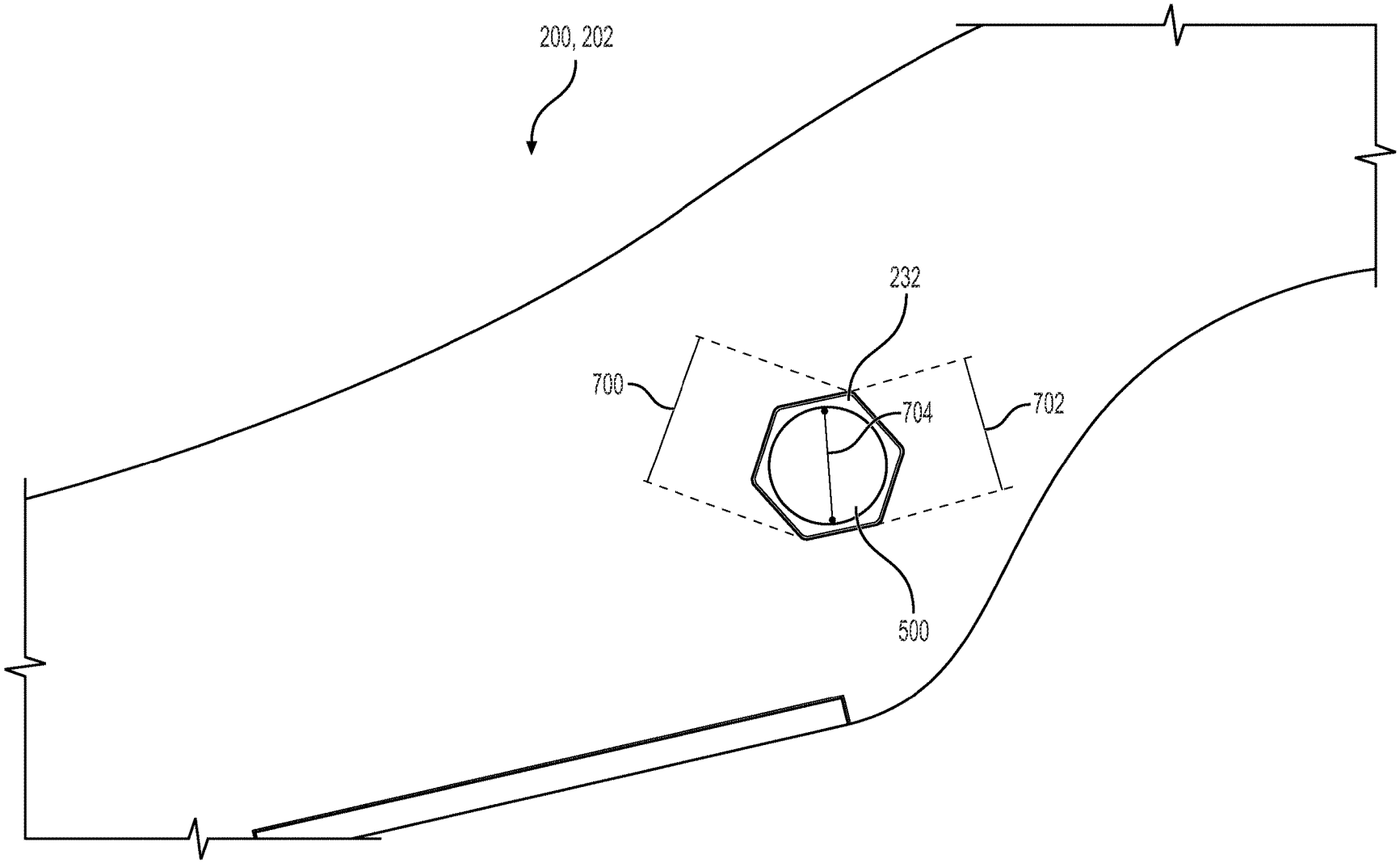
FIG. 7 is a side view of first and second side plates of the thumb of FIG. 2 with the thumb actuator pivot pin installed.

FIG. 7 shows a side view of first and second first and second side plates 200, 202 (which can be mirror images of each other) of thumb 110 with thumb actuator pivot pin 500 installed. In one embodiment, side plate openings 232, which receive thumb actuator pivot pin 500 when installing thumb actuator pivot pin 500 on thumb 110, may have a hexagonal shape. Side plate openings 232 may have a maximum diameter 700 between diametrically-opposed vertices of the hexagon shape defined by side plate openings 232 and a minimum diameter 702 defined a line intersecting diametrically opposed sides of the hexagon shape at right angles.

To accommodate thumb actuator pivot pin 500, minimum diameter 702 of the hexagonal shape of side plate openings 232 may be at least a diameter 704 of thumb actuator pivot pin 500 (which has a cylindrical shape). For example, minimum diameter 702 of side plate openings 232 may be equal to diameter 704 of thumb actuator pivot pin 500 plus a certain tolerance (e.g., 10%) allowing for easy insertion of thumb actuator pivot pin 500 into side plate openings 232. Based on the known properties of the hexagon shape, maximum diameter 700 of side plate openings 232 may be equal to $$d = D * \frac{\sqrt{3}}{2}$$

where d is minimum diameter 702 and D is maximum diameter 700 of side plate openings 232.

INDUSTRIAL APPLICABILITY

This disclosure applies to any machine, such as an excavator or a backhoe, having an implement with an opposing thumb. The disclosed thumb 110 with yoke assembly 222 may allow for weight and cost reduction in the construction of the thumb and/or other components of the machine as well as improve the function of the thumb and/or the machine.

For example, inner collar spacers 234 on first and second yoke plates 224, 226 may allow for a smaller thumb actuator 120 and/or a thumb actuator 120 with a cylinder head 600 having a smaller attachment end 602. This may provide the option to use a cheaper, smaller, and/or lighter thumb actuator 120 on machine 100. In addition to saving cost and/or weight on the thumb actuator 120 alone, the reduction in weight may allow for cascading improvements and/or cost savings throughout machine 100. For example, with a lighter or lighter-duty thumb actuator 120, a designer or engineer may similarly scale down the existing linkage assembly 102, actuators 114, 116, 118, and/or the hydraulic system on machine 100 in proportion to the scaling down of thumb actuator 120, further reducing the weight and cost of machine 100.

By the same token, adding inner collar spacers 234 on first and second yoke plates 224, 226 may make thumb 110 interchangeable with different types of machines. For example, without inner collar spacers 234, thumb 110 might be used on a larger machine having a larger cylinder head. But adding inner collar spacers 234 may allow the use of thumb 110 on a smaller machine having a smaller cylinder head and/or a cylinder head with a narrower attachment end.

First and second reinforcement ribs 242, 244 may also provide certain benefits. For example, as discussed above, the configuration and arrangement of first and second reinforcement ribs 242, 244 may allow some flexing or bending of first and second yoke plates 224, 226, eliminating concentrated stresses on first and second yoke plates 224, 226 while still providing sufficient reinforcement and support for proper operation of thumb 110 when handling material loads. The elimination of concentrated stresses may help prevent unnecessary wear and/or damage to thumb 110, extending its service life. Additionally, first and second reinforcement ribs 242, 244 may reduce the weight of thumb 110 in comparison to larger yoke plate reinforcement structures that, for example, span the length of the yoke plates. Accordingly, in addition to inner collar spacers 234, the weight reduction provided by first and second reinforcement ribs 242, 244 may also allow for improvements and/or cost savings by similarly scaling down other components of machine 100, such a linkage assembly 102, actuators 114, 116, 118, 120, and/or the hydraulic system.

Additionally, the disclosed thumb 110 with hexagonal-shaped side plate openings 232 may offer several advantages over conventional thumbs. For example, in comparison to conventional thumbs with circular side plate openings, the disclosed thumb 110, and/or machine 100 to which it is attached, may be more readily identified in an environment having a number of similar-looking excavation machines with similar-looking implements. For example, a machine operator may more easily find machine 100 on a worksite when thumb 110 of machine 100 has hexagonal-shaped side plate openings 232 and the remaining machines have circular ones. As another example, if a technician is looking for a particular machine 100 having a particular make or model thumb 110 to perform service, and the technician knows that make or model thumb 110 has hexagonal-shaped side plate openings 232, the technician may more quickly identify machine 100 among the other machines on the site.

The disclosed thumb 110 may also allow easier installation of thumb actuator pivot pin 500 than conventional thumbs having circular side plate openings. In particular, the hexagonal shape of side plate openings 232 may provide more room than a corresponding circular opening to insert thumb actuator pivot pin 500. This is because maximum diameter 700 between diametrically-opposed vertices of the hexagonal side plate openings 232 is substantially greater than diameter 704 of thumb actuator pivot pin 500 when minimum diameter 702 of site plate openings 232 is substantially equal to diameter 704 of thumb actuator pivot pin 500. This creates additional space between the vertices of side plate openings 232 and the circumferential edge of diameter 704 of thumb actuator pivot pin 500 in comparison to a circular opening with a diameter substantially equal to diameter 704 thumb actuator pivot pin 500. And, this additional space makes it easier for the installer to set, align, and insert thumb actuator pivot pin 500 into side plate openings 232 when installing thumb 110 on machine 100.

Although the foregoing description refers to use of the invention with a bucket, the invention is not limited thereto, and can be employed with any suitable machine implement.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A thumb for an implement of a machine, the thumb comprising:

first and second side plates each having a pivot end for pivotally connecting to a linkage of the machine and an engagement end for engaging with a load;

a belly plate extending across a width of the thumb between the first and second side plates and extending along a length of the thumb from the pivot end toward the engagement end;

a yoke assembly mounted to a surface of the belly plate and configured to connect the thumb to a thumb actuator that pivots the thumb about the pivot end, the yoke assembly including:

a first yoke plate having a first yoke plate opening;

a second yoke plate opposing the first yoke plate and having a second yoke plate opening aligned with the first yoke plate opening;

a first inner collar spacer mounted to an inner surface of the first yoke plate aligned with the first yoke plate opening;

a second inner collar spacer mounted to an inner surface of the second yoke plate aligned with the second yoke plate opening; and a thumb support structure disposed at the engagement end, the thumb support structure including:

a first support plate having a first convex side facing the pivot end and a first concave side facing the engagement end, the first convex side being connected to the belly plate, a second support plate having a second convex side facing the engagement end and a second concave side facing the pivot end, the second concave side being connected to the first concave side and forming a cavity, and a third support plate being connected to the first convex side and an interior side of the belly plate.

2. The thumb of claim 1, wherein the yoke assembly further comprises an outer collar mounted to an outer surface of the first yoke plate, the outer collar being configured to retain a thumb actuator pivot pin inserted through the first and second yoke plate openings.

3. The thumb of claim 2, wherein the outer collar includes an opening configured to receive a fastener to fasten the thumb actuator pivot pin within the first and second yoke plate openings.

4. The thumb of claim 2, wherein at least one of the first and second side plates includes a side plate opening aligned with the first and second yoke plate openings, the side plate opening being configured to receive the thumb actuator pivot pin when the thumb actuator pivot pin is inserted through the first and second yoke plate openings.

5. The thumb of claim 1, wherein the yoke assembly further includes:

a first reinforcement rib extending from an inner surface of the first side plate, along the surface of the belly plate, to an outer surface of the first yoke plate, the first reinforcement rib reinforcing the first yoke plate against forces applied at the first yoke plate opening; and a second reinforcement rib extending from an inner surface of the second side plate, along the surface of the belly plate, to an outer surface of the second yoke plate, the second reinforcement rib reinforcing the second yoke plate against forces applied at the second yoke plate opening.

6. The thumb of claim 5, wherein the first and second reinforcement ribs are respectively located on a yoke plate opening side of the first and second yoke plates.

7. The thumb of claim 5, wherein a height of the first and second reinforcement ribs as measured from the surface of the belly plate is less than a height of the first and second yoke plates as measured from the surface of the belly plate.

8. The thumb of claim 5, wherein a width of the first and second reinforcement ribs is less than the height of the first and second reinforcement ribs.

9. The thumb of claim 1, wherein the first and second yoke plates are configured to receive a cylinder head attachment end of the thumb actuator between the first and second inner collar spacers.

10. A method of providing a thumb for an implement of a machine, the method comprising:

providing first and second side plates each having a pivot end for pivotally connecting to a linkage of the machine and an engagement end for engaging with a load;

providing a belly plate extending across a width of the thumb between the first and second side plates and extending along a length of the thumb from the pivot end toward the engagement end; and mounting a yoke assembly to a surface of the belly plate, the yoke assembly being configured to connect the thumb to a thumb actuator that pivots the thumb about the pivot end, the mounting the yoke assembly including:

mounting, to the surface of the belly plate, a first yoke plate having a first yoke plate opening;

mounting, to the surface of the belly plate, a second yoke plate opposing the first yoke plate and having a second yoke plate opening aligned with the first yoke plate opening;

mounting, to an inner surface of the first yoke plate aligned with the first yoke plate opening, a first inner collar spacer;

mounting, to an inner surface of the second yoke plate aligned with the second yoke plate opening, a second inner collar spacer;

attaching a first reinforcement rib to the surface of the belly plate at a pivot end side of the first yoke plate opening, the first reinforcement rib extending from an inner surface of the first side plate to the outer surface of the first yoke plate, the first reinforcement rib having six rectangular sides including a first rectangular end and a second rectangular end opposite the first rectangular end, the first rectangular end connected to the inner surface of the first side plate and the second rectangular end connected to the outer surface of the first yoke plate; and attaching a second reinforcement rib to the surface of the belly plate at a pivot end side of the second yoke plate opening, the second reinforcement rib extending from an inner surface of the second side plate to the outer surface of the second yoke plate, the second reinforcement rib having six rectangular sides including a first rectangular end and a second rectangular end opposite the first rectangular end, the first rectangular end connected to the inner surface of the second side plate and the second rectangular end connected to the outer surface of the second yoke plate.

11. The method of claim 10, further including mounting, to the outer surface of the first yoke plate, an outer collar configured to retain a thumb actuator pivot pin inserted through the first and second yoke plate openings.

12. The method of claim 11, further including providing, in the outer collar, an opening configured to receive a fastener to fasten the thumb actuator pivot pin within the first and second yoke plate openings.

13. The method of claim 11, further comprising providing, in at least one of the first and second side plates, a side plate opening aligned with the first and second yoke plate openings, the side plate opening being configured to receive the thumb actuator pivot pin when the thumb actuator pivot pin is inserted through the first and second yoke plate openings.

14. The method of claim 10, wherein:

the first reinforcement rib reinforces the first yoke plate against forces applied at the first yoke plate opening; and the second reinforcement rib reinforces the second yoke plate against forces applied at the second yoke plate opening.

15. The method of claim 10, further comprising:

disposing a thumb support structure at the engagement end, the thumb support structure including:

a first support plate having a first convex side facing the pivot end and a first concave side facing the engagement end, the first convex side being connected to the belly plate, a second support plate having a second convex side facing the engagement end and a second concave side facing the pivot end, the second concave side being connected to the first concave and forming a cavity, and a third support plate being connected to the first convex side and an interior side of the belly plate.

16. The method of claim 14, wherein a height of the first and second reinforcement ribs as measured from the surface of the belly plate is less than a height of the first and second yoke plates as measured from the surface of the belly plate.

17. The method of claim 16, wherein a width of the first and second reinforcement ribs is less than the height of the first and second reinforcement ribs.

18. A machine, comprising:

a linkage; and an implement pivotally connected to the linkage and having a thumb, the thumb including:

first and second side plates each having a pivot end for pivotally connecting to the linkage and an engagement end for engaging with a load;

a belly plate extending across a width of the thumb between the first and second side plates and extending along a length of the thumb from the pivot end toward the engagement end;

a yoke assembly mounted to a surface of the belly plate and configured to connect the thumb to a thumb actuator that pivots the thumb about the pivot end, the yoke assembly including:

a first yoke plate having a first yoke plate opening;

a second yoke plate opposing the first yoke plate and having a second yoke plate opening aligned with the first yoke plate opening;

a first inner collar spacer mounted to an inner surface of the first yoke plate aligned with the first yoke plate opening; and a second inner collar spacer mounted to an inner surface of the second yoke plate aligned with the second yoke plate opening, and a thumb support structure disposed at the engagement end, the thumb support structure including;

a first support plate having a first convex side facing the pivot end and a first concave side facing the engagement end, the first convex side being connected to the belly plate, a second support plate having a second convex side facing the engagement end and a second concave side facing the pivot end, the second concave side being connected to the first concave side and forming a cavity, and a third support plate being connected to the first convex side and an interior side of the belly plate.

19. The machine of claim 18, wherein the yoke assembly further comprises an outer collar mounted to an outer surface of the first yoke plate, the outer collar including an opening configured to receive a fastener to fasten a thumb actuator pivot pin inserted through the first and second yoke plate openings.

20. The machine of claim 18, wherein the yoke assembly further includes:

a first reinforcement rib extending from an inner surface of the first side plate, along the surface of the belly plate, to an outer surface of the first yoke plate, the first reinforcement rib reinforcing the first yoke plate against forces applied at the first yoke plate opening; and a second reinforcement rib extending from an inner surface of the second side plate, along the surface of the belly plate, to an outer surface of the second yoke plate, the second reinforcement rib reinforcing the second yoke plate against forces applied at the second yoke plate opening.

21. A thumb for an implement of a machine, the thumb comprising:

first and second side plates having a pivot end for pivotally connecting to a linkage of the machine and an engagement end for engaging with a load;

a belly plate extending across a width of the thumb between the first and second side plates and extending along a length of the thumb from the pivot end toward the engagement end;

first and second yoke plates mounted to a surface of the belly plate, the first and second yoke plates having respective first and second yoke plate openings for retaining a thumb actuator pivot pin that pivotally connects the thumb to a thumb actuator;

first and second side plate openings respectively in the first and second side plates, the first and second side plate openings for receiving the thumb actuator pivot pin for insertion through the first and second yoke plate openings, wherein at least one of the first and second side plate openings has a hexagonal shape;

a first reinforcement rib attached to the surface of the belly plate at a pivot end side of a first yoke plate opening of the first yoke plate, the first reinforcement rib extending from an inner surface of the first side plate to an outer surface of the first yoke plate, the first reinforcement rib having six rectangular sides including a first rectangular end and a second rectangular end opposite the first rectangular end, the first rectangular end connected to the inner surface of the first side plate and the second rectangular end connected to the outer surface of the first yoke plate; and a second reinforcement rib attached to the surface of the belly plate at a pivot end side of a second yoke plate opening of the second yoke plate, the second reinforcement rib extending from an inner surface of the second side plate to an outer surface of the second yoke plate, the second reinforcement rib having six rectangular sides including a first rectangular end and a second rectangular end opposite the first rectangular end, the first rectangular end connected to the inner surface of the second side plate and the second rectangular end connected to the outer surface of the second yoke plate.

22. The thumb of claim 21, further comprising:

a thumb support structure disposed at the engagement end, the thumb support structure including:

a first support plate having a first convex side facing the pivot end and a first concave side facing the engagement end, the first convex side being connected to the belly plate, a second support plate having a second convex side facing the engagement end and a second concave side facing the pivot end, the second concave side being connected to the first concave side and forming and forming a cavity, and a third support plate being connected to the first convex side and an interior side of the belly plate.

* * * * *